US006123173A

United States Patent [19]

Patros

[11] Patent Number: 6,123,173

[45] Date of Patent: Sep. 26, 2000

[54] EXTENDABLE SAWHORSE TOP RAIL

[76] Inventor: George Patros, 645 NE. Fairmont St., Fridley, Minn. 55432

[21] Appl. No.: 09/312,680

[22] Filed: May 17, 1999

Related U.S. Application Data

[63] Continuation-in-part of application No. 08/958,421, Oct. 27, 1997, Pat. No. 5,904,225.

[51] Int. Cl.[7] ..... E04G 1/00

[52] U.S. Cl. ..... 182/181.1; 182/183.1; 182/129

[58] Field of Search ..... 182/181.1, 183.1, 182/224, 129; 144/287, 144.5 R, 286 R, 307; 269/795

[56] References Cited

U.S. PATENT DOCUMENTS

| | | | |
|---|---|---|---|
| 79,079 | 6/1868 | Pierce et al. . | |
| 89,306 | 4/1869 | Goodher . | |
| 970,508 | 9/1910 | Kamrath . | |
| 1,357,970 | 11/1920 | Felland . | |
| 1,580,935 | 4/1926 | Vidon . | |
| 1,583,652 | 5/1926 | Brooks . | |
| 1,841,676 | 1/1932 | Roberts . | |
| 2,431,898 | 12/1947 | Witken . | |
| 2,714,755 | 8/1955 | Wright | 24/458 |
| 4,804,064 | 2/1989 | Coultrup et al. . | |
| 5,161,590 | 11/1992 | Otto | 144/286 R |
| 5,236,166 | 8/1993 | Darling . | |
| 5,402,860 | 4/1995 | Fry . | |
| 5,823,239 | 10/1998 | Smith . | |
| 5,836,365 | 11/1998 | Derecktor . | |
| 5,865,269 | 2/1999 | Eskesen | 182/153 |

*Primary Examiner*—Alvin Chin-Shue
*Attorney, Agent, or Firm*—Nikolai, Mersereau & Dietz, P.A.

[57] ABSTRACT

A sawhorse extender attachment adapted to be affixed to the cross beam member of a conventional sawhorse that allows the effective length of the sawhorse to be adjusted. The attachment device comprises a base member having a dove-tail groove extending the full length thereof along with a pair of extension members of a trapezoidal cross-section adapted to slidingly fit within the longitudinal groove in the base member. The extension members can be extended and retracted relative to the length of the base member and locked in place at predetermined locations along the length of the elongated dove-tail groove. Provision is made for stops placed into the extension members to be selectively deployed where the stops project above the top surface thereof for inhibiting lateral shifting of any work piece resting on the sawhorse extender. The sawhorse extender attachment is designed to incorporate various accessories, including workpiece clamps, electrical outlets, a saw guide and spirit level.

15 Claims, 9 Drawing Sheets

EXTENDABLE SAWHORSE TOP RAIL

CROSS-REFERENCE TO RELATED APPLICATION

This application is a continuation-in-part of application Ser. No. 08/958,421, filed Oct. 27, 1997 (now U.S. Pat. No. 5,904,225, issued May 18, 1999).

BACKGROUND OF THE INVENTION

1. Field of the Invention

This invention relates generally to sawhorses used in supporting work pieces at a convenient height as work is being performed on the work pieces, and more particularly to an attachment for such sawhorses for providing axial extension of the work surface for firm support of work pieces of varying size and shapes.

2. Discussion of the Prior Art

Conventional, prior art sawhorses generally comprise first and second pairs of legs that are joined together by an elongated cross beam where the legs of each pair come together at an acute angle at the point where they join to the cross beam. Such devices have been used for centuries by carpenters and other workmen for supporting work pieces, such as lumber, panels, pipes, etc., at a convenient height so that the workmen can stand while performing operations on the object in question.

Sawhorses whose length and height dimensions can be adjusted to accommodate differing sizes and shapes of work pieces are known in the art. Exemplary of such sawhorses of adjustable size and height are described in the following U.S. Patents:

Fry—U.S. Pat. No. 5,402,860

Coultrup et al.—U.S. Pat. No. 4,804,064

Witken—U.S. Pat. No. 2,431,898

Vidon—U.S. Pat. No. 1,580,935

Kamrath—U.S. Pat. No. 970,508

Goodher—U.S. Pat. No. 89,306

In each of the above exemplary prior art adjustable length sawhorses, it is the cross beam of the sawhorse itself that is designed to be telescopingly extended and collapsed in adjustment of the overall length dimension thereof.

Many sawhorses are now in use that have a solid, non-extendable cross beam member. Such sawhorses are commonly about 36 inches in length and made from wood or metal and generally have foldable legs so that they can be collapsed and more readily transported between job sites. When working on larger panels, such as 4'×8' sheets of plywood, doors, windows or the like, it is somewhat difficult to stabilize the work piece against shifting when supported on two such non-extendable sawhorses. Thus, a need exists for an accessory device that may readily be attached to a standard, non-extendable sawhorse for permitting stable support for a variety of work pieces of differing sizes and shape configurations. It is the object of the present invention to fulfill this need.

SUMMARY OF THE INVENTION

The present invention involves a sawhorse extender that comprises a base member of a predetermined length, width and depth dimension that is adapted to be attached by bolts or otherwise to a cross member of a conventional sawhorse. The base member is of a generally rectangular cross section and it includes at least one centrally located, elongated containment groove, such as a dove-tail groove or T-slot that extends the full length dimension of the base member. First and second extension members, each of a length that is approximately one-half of the predetermined length of the base member are provided and they have a cross sectional shape allowing them to be slidingly received in the containment groove in the base member. A spring-loaded latching pin cooperates with the base member and with the first and second extension members for positively locking the first and second extension members in place at predetermined locations along the length of the elongated containment groove.

Formed inwardly of the top surface of the first and second extension members is a cylindrical bore of a predetermined depth into which may be inserted a cylindrical peg designed so that it projects above the top surface of the extension members. A work piece placed between the projecting cylindrical pegs serves to prevent shifting of the work piece relative to the sawhorse as manipulations are being performed on the work piece.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF A PREFERRED EMBODIMENT

Figure 1:
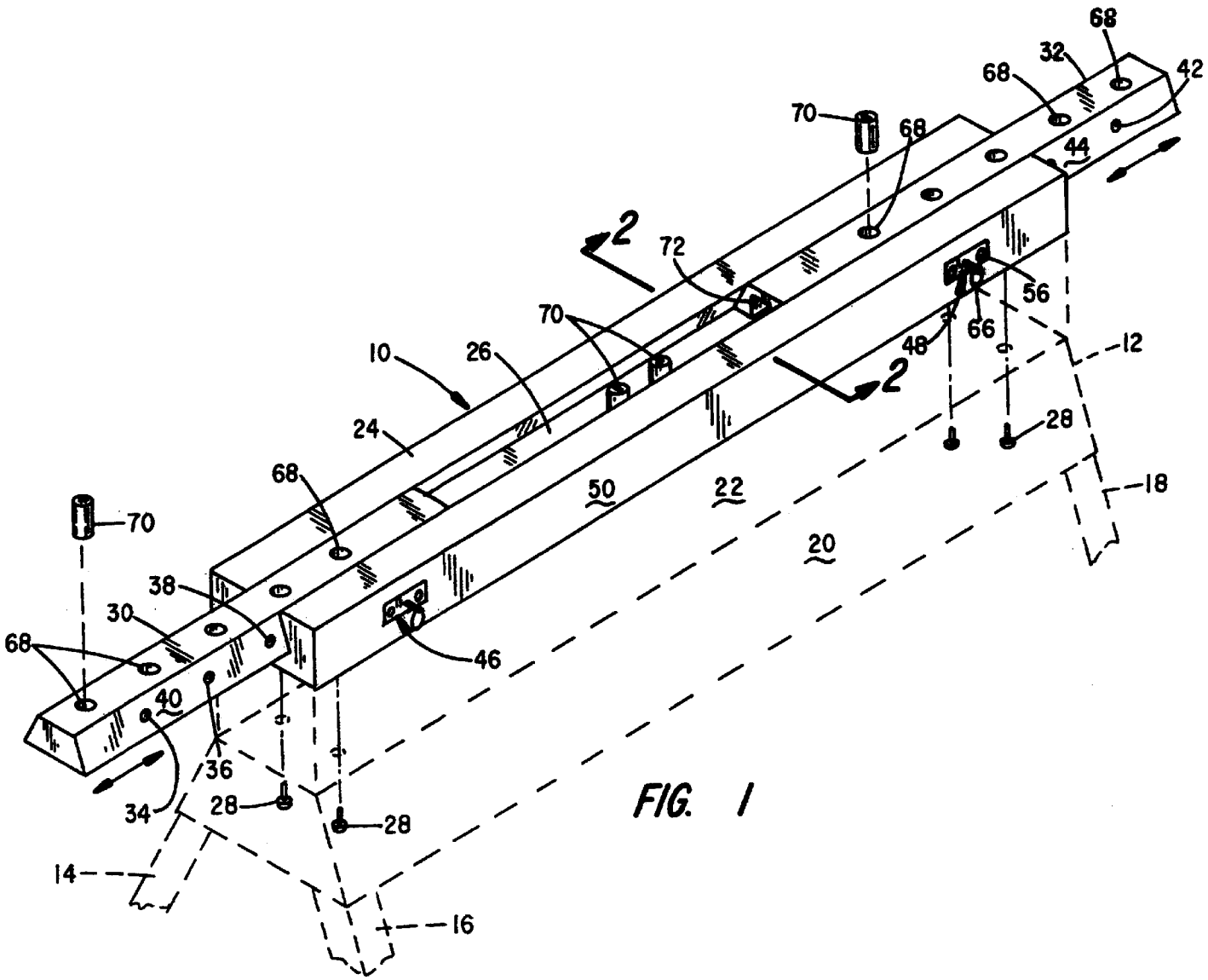
FIG. 1 is an exploded perspective view of the sawhorse extender attachment constructed in accordance with the present invention.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

FIG. 1 illustrates by means of a perspective drawing a preferred embodiment of an extendable top rail attachment for a sawhorse. It is indicated generally by numeral 10, with an upper portion of a conventional sawhorse 12 being shown in phantom line. The sawhorse includes a pair of non-parallel legs 14–16 at one end thereof and corresponding legs at the opposite end thereof, of which only leg 18 is visible. Spanning the legs is a top rail member 20 having a generally horizontal, planar upper surface 22.

Figure 2:
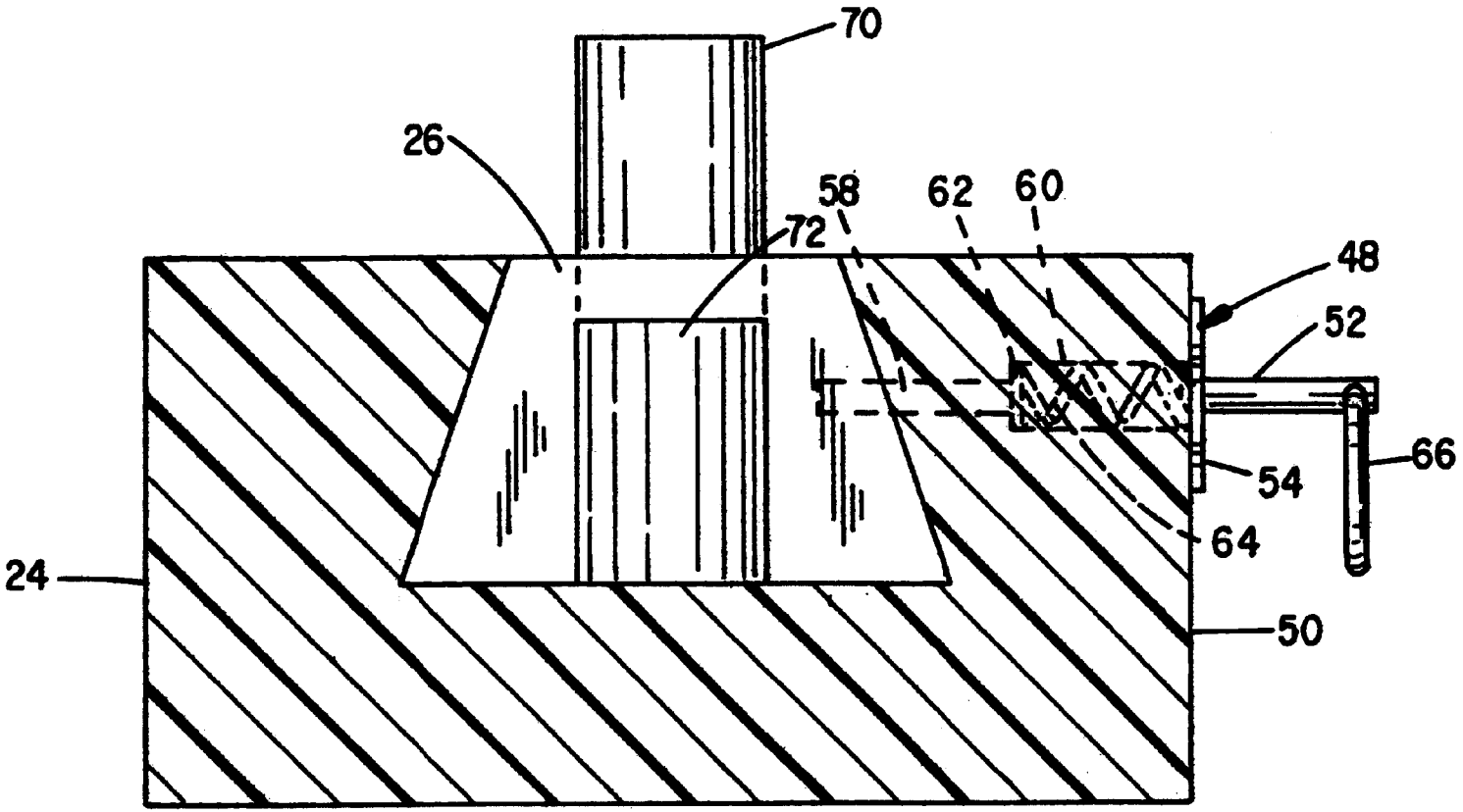
FIG. 2 is a cross-sectional view taken along the line 2—2 in FIG. 1.

The extendable top rail assembly 10 includes a base member 24 which, as seen in the cross-sectional view of FIG. 2, is generally rectangular in cross section and includes at least one elongated containment groove 26 running the full length thereof. The base member may be formed of wood, metal or a suitable plastic, such as polyurethane. The channel 26 is shown as being trapezoidal in shape to define a dove-tail groove with the base of the trapezoidal channel being wider than its top. The base member 24 of the sawhorse extender 10 is adapted to be bolted or otherwise affixed as by bolts 28 to the surface 22 of the top rail 20 of the sawhorse 12.

First and second extension members 30 and 32, each of a length that is about one-half of the length of the base member have a cross-sectional shape corresponding to the dove-tail groove 26 of the base member, thereby allowing the extension members 30 and 32 to be slidingly received in the dove-tail shaped containment groove 26 of the base member 24. Those skilled in the art can appreciate that the channel need not be trapezoidal in cross-section, but need only be of a cross-sectional shape so that the extension member can axially slide in the channel, but cannot be extracted from it except from its end.

As can be seen in FIG. 1, a series of cylindrical bores 34, 36, 38 are formed inwardly of a sloping side surface 40 on the extension member 30 and, likewise, similar bores, as at 42, are formed in the sloping side wall 44 of the extension member 32. These bores or apertures formed inwardly of the side walls 40 and 44 of the extension members 30 and 32 are adapted to cooperate with a spring-loaded locking pin assembly 46 and 48 mounted in the side wall 50 of the base member 24.

Referring again to FIG. 2, the spring-loaded locking pin assembly 48 is seen to include an elongated steel pin 52 that passes through an aperture in a mounting plate 54 that is attached to the wall 50 of the base member by screws, as at 56. Formed in the base member 24 beneath the mounting plate 54 is a horizontally extending bore 58 of a diameter slightly larger than the diameter of the pin 52 and a counterbore 60 of a somewhat larger diameter such that an annular flange 62 formed on the pin 52 can slide within the counterbore 60. The counterbore 60 also receives a compression spring 64 therein that cooperates with the annular flange 62 and mounting plate 54 to urge the pin 52 inwardly. A grasping ring 66 is affixed to the outer end of the pin 52 allowing the user to readily pull back on the pin against the force of the spring 64 so that the pin 52 is retracted fully from the dove-tail shaped containment groove 26, allowing the extension member 32 to freely slide with the dove-tail channel. When the degree of extension of the end of the extension member 32 beyond that of the base member 24 is arrived at, the user may release the grasping ring 66, allowing the pin 52 to press against the side wall 44 of the extension member. Then, by slightly moving the extension member in one direction or the other, the pin will fall into a selected one of the bores 42, etc. formed laterally in the sloping side wall 44 of the extension member 32. The spring-loaded locking pin assembly 46 cooperates with the extension member 30 in just the same fashion.

It has also been found convenient to provide a series of vertically directed cylindrical bores, as at 68, in the exposed top surfaces of the extension members 30 and 32. Cooperating with these bores are cylindrical pegs 70 which can be selectively positioned in any one of the bores 68 to function as an edge stop for a work piece (not shown) to prevent lateral shifting thereof as the workmen perform sawing, drilling or other operations on that work piece. An additional pair of cylindrical bores are formed in the base member 24 in the center of the dove-tail groove 26 for the purpose of storing pegs 70 when not in use. For this purpose, the inner ends of the extension members 30 and 32 have a recess as at 72 so that the ends of the extension members can be made to abut one another without interfering with the pegs 70 when in their storage position within the channel 26.

Strictly for the purpose of illustration and without any limitation intended, the base member 24 may be 36 inches in length, 2-½ inches high and 4-¾ inches wide. Its containment groove or channel 26 is preferably, but not necessarily, centered across the width dimension and designed to receive a correspondingly shaped extension member 30, 32. If the containment groove is trapezoidal as illustrated, the extension members may, for example, have a major base of 2-½ inches in length and a minor base of 1-½ inches. The extension members 30 and 32 may each be 18 inches in length and the stop holes 34, 36, etc. may be on 3 inch centers to allow for varying degrees of extension beyond the ends of the base member 24. The bores 68 for receiving the dowels or pegs 70 may be dimensioned to receive a ¾ inch diameter peg with low friction. Those bores may be on 3 inch centers and preferably positioned between the stop pin bores 34, 36, etc. formed in the extension members.

ALTERNATIVE EMBODIMENTS OF THE INVENTION

In the preferred embodiments illustrated in FIGS. 1 and 2, the base member 24 of the sawhorse extender as well as the extension members 30 and 32 thereof are shown as solid pieces of wood or plastic. This necessarily adds to the overall weight of the device. Moreover, if formed in a molding operation, it unduly increases the manufacturing cost of the device.

Figure 3:
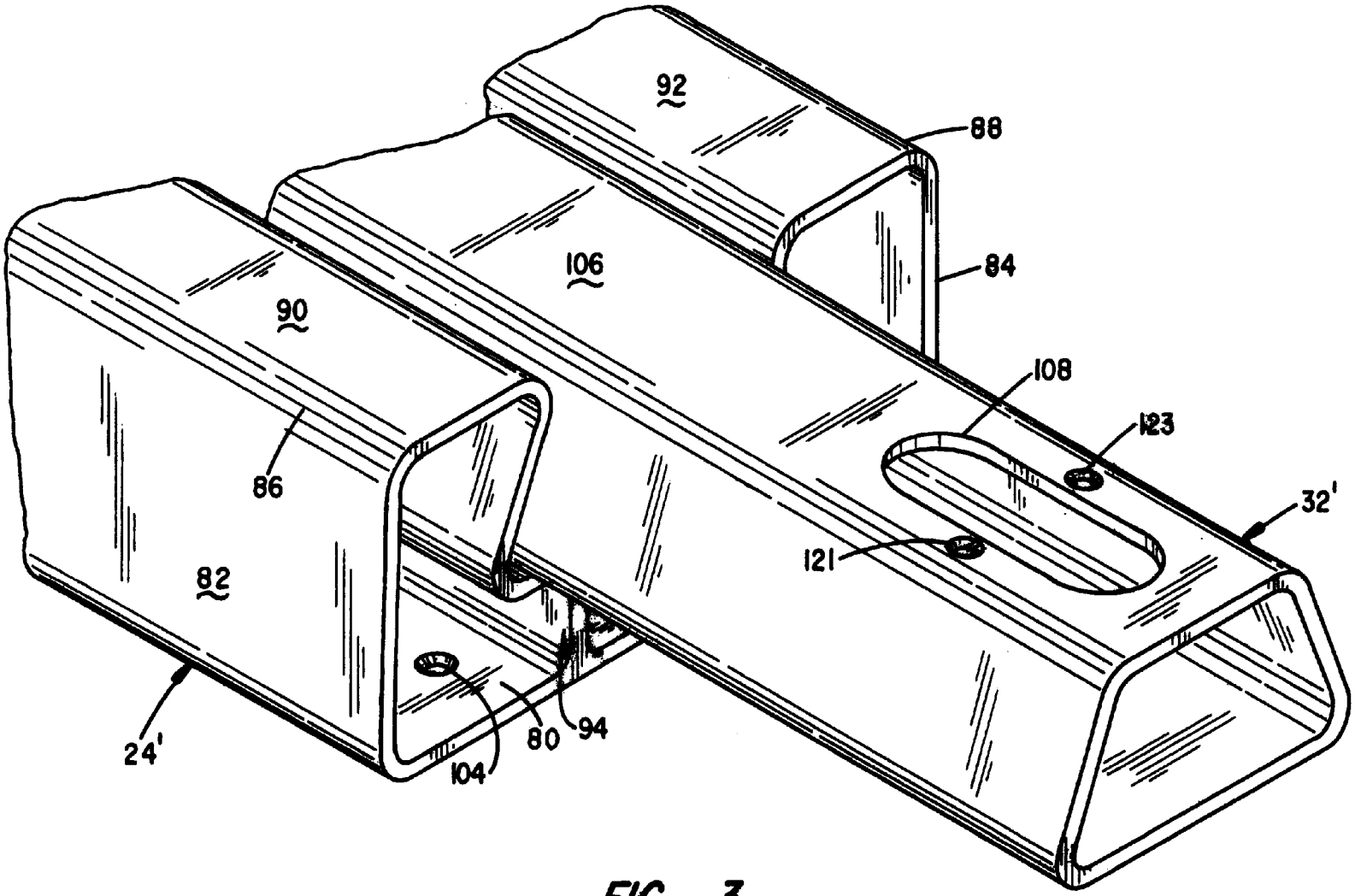
FIG. 3 is a partial perspective view of the end portion of a sawhorse extender attachment in accordance with an alternative embodiment of the invention.

In the alternative embodiment illustrated in FIG. 3, the base member 24' preferably comprises an extruded fiberglass reinforced plastic or metal (aluminum) piece that is cut to a length suitable for attachment to a conventional sawhorse. The base member 24' includes a generally planar bottom surface 80 with integrally formed, vertically extending sidewalls 82 and 84 of a predetermined height dimension. Contiguous with the upper edges 86 and 88 of the sidewalls 82 and 84 are inwardly extending top surfaces 90 and 92 which extend parallel to the bottom 80.

Figure 5:
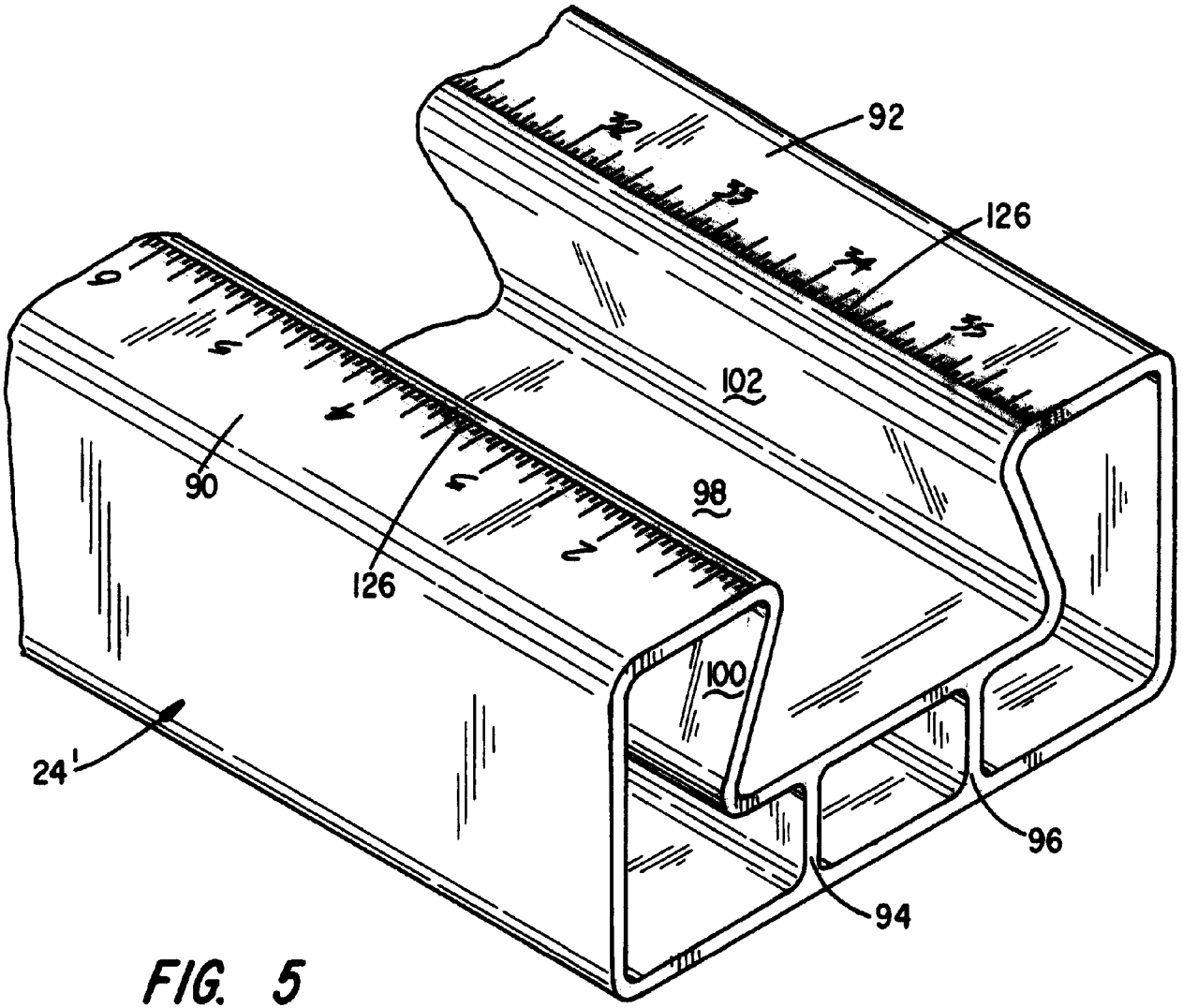
FIG. 5 is a partial perspective view of a base member of the sawhorse extender incorporating measuring scales.

With reference next to FIG. 5, there can be seen projecting upwardly from the bottom 80 of the base member 24' first and second longitudinally extending ribs 94 and 96. They provide support for an integrally formed planar platform 98. Opposed side edges of the platform 98 are integrally joined with the edges of the top surfaces 90 and 92 by way of inwardly and upwardly sloped walls 100 and 102 which, along with the platform 98, form a trapezoidal-shaped containment groove for receiving at least one, but preferably two, extension members as at 32' in FIG. 3. As is apparent from FIGS. 3 and 5, the base member 24', as well as the extension members 32' are generally hollow tubular extruded metal or plastic structures which significantly reduces the weight and amount of material required as compared to the embodiments shown in FIGS. 1 and 2.

When a fiberglass reinforced plastic is used as the base member, it is preferable that the extender members comprise a metal, such as aluminum. This reduces any tendency for the slidable extender member to stick to the abutting surfaces of the containment channel.

As is seen in FIG. 3, the extension members 32' have a cross-sectional shape that conforms to the shape of the containment groove defined by the sloping surfaces 100 and 102 and the intermediate platform 98. As such, the extension member 32' can only be inserted into the containment groove from the end. More importantly, when the extension member 32' is extended beyond the end of the base member 24' and a downward force is applied to the end portion of the extension member, it is precluded from rotating out of the containment groove. While the containment groove and extension members shown in FIG. 3 each have a trapezoidal cross-section, those skilled in the art can appreciate that other shapes can be adopted for mating the extension members to the base so that the extension members can only be separated from the base by withdrawing same from the end edge of the base.

As with the embodiment of FIGS. 1 and 2, the base member 24' is adapted to be affixed to the top surface of a conventional sawhorse by screws passing through mounting holes, as at 104, in FIG. 3.

Figure 4:
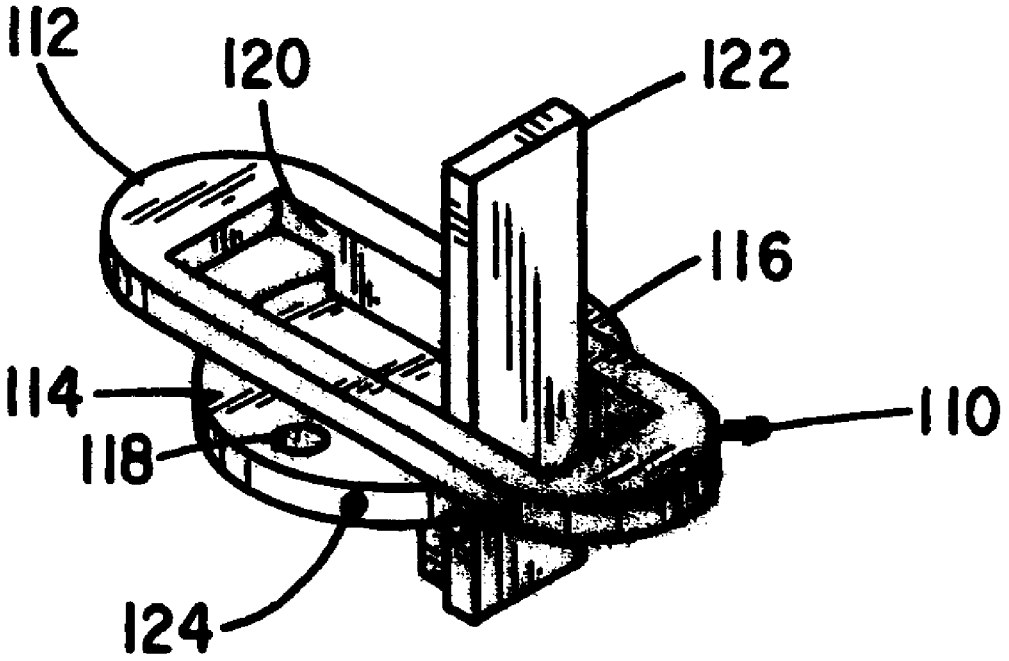
FIG. 4 is a perspective view of a pop-up stop that is adapted to be assembled to the embodiment of FIG. 3.

In the embodiment shown in FIG. 3, rather than using removable pegs as workpiece stops as in the embodiment of FIG. 1, there is formed through the top surface 106 of the extension member 32' an oval-shaped opening 108 that is adapted to receive the pop-up work-piece stop assembly identified by reference number 110 illustrated in FIG. 4. The pop-up stop member 110 comprises an oval-shaped plate 112 sized to fit in opening 108 and having mounting flanges 114 and 116 affixed to an undersurface thereof where the mounting flanges include tapped holes, as at 118, for receiving screws passing through counter-sunk apertures 121 and 123 formed in the upper surface 106 of the extension member 32'. The oval plate 112 includes a generally rectangular opening 120 and pivotally mounted within the opening 120 is a stop member 122. The pivot is provided by a pin (not shown) fitted into a bore 124 formed horizontally through the flange 114 and the stop member 122.

When not being used, the stop member 122 lies flat within the opening 120. It may be deployed to the vertical position illustrated in FIG. 4 by merely depressing the rightmost end of the stop member 122 so as to tip it to its vertical position. When so deployed, it functions to inhibit shifting of a workpiece placed on the sawhorse while it is being cut, drilled, sanded or otherwise worked upon. While only one such stop member is illustrated in the partial view of FIG. 3, it is to be appreciated that additional stop members may be deployed along the length of each of the extension members at predetermined locations in the same way that the peg-receiving bores 68 in the embodiment of FIG. 1 are located.

For convenience, and as is illustrated in FIG. 5, scale markings, as at 126, may be stamped or engraved on the top surfaces 90 and 92 of the base member 24' to be used as a guide in setting the degree of extension of the extension members relative to the base and/or for aligning the workpiece on the sawhorse.

As a further convenience, the sawhorse extender of the present invention may include one or more electrical outlets 128 for allowing a variety of power tools to be plugged in and supplied with electricity. The outlets 128 would be connected by wiring (not shown) extending through the hollow interior of the base member 24' and connected by an extension cord to a live electrical outlet.

Figure 6:
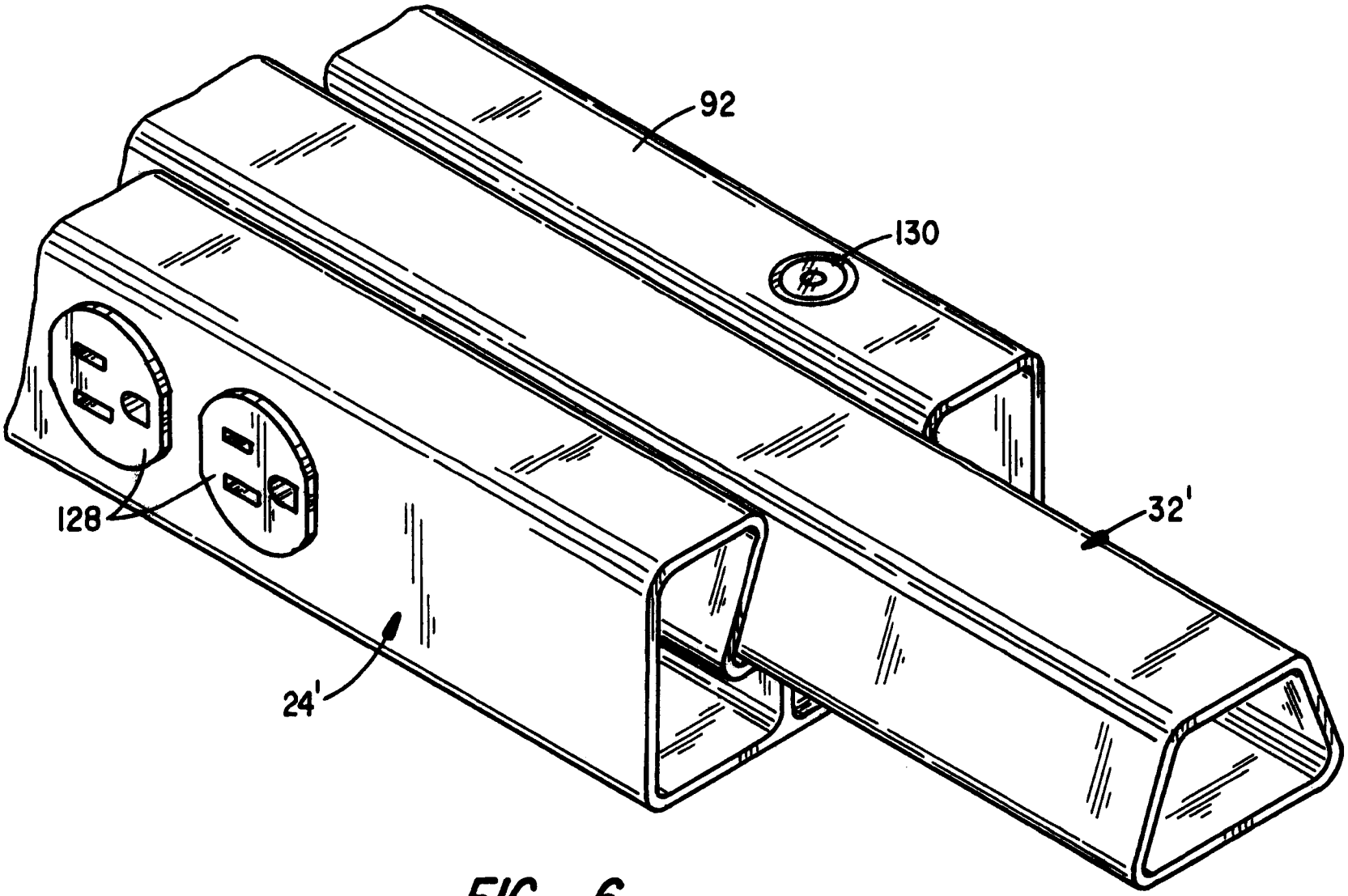
FIG. 6 is a partial perspective view of a further alternative embodiment of the sawhorse extender incorporating electrical outlets and a spirit level.

Another feature illustrated in FIG. 6 is the addition of a spirit level 130 mounted in the top surface 92 of the base member 24' which can be used to insure that the top surface of the sawhorse extender is accurately aligned with the horizontal.

Figure 7:
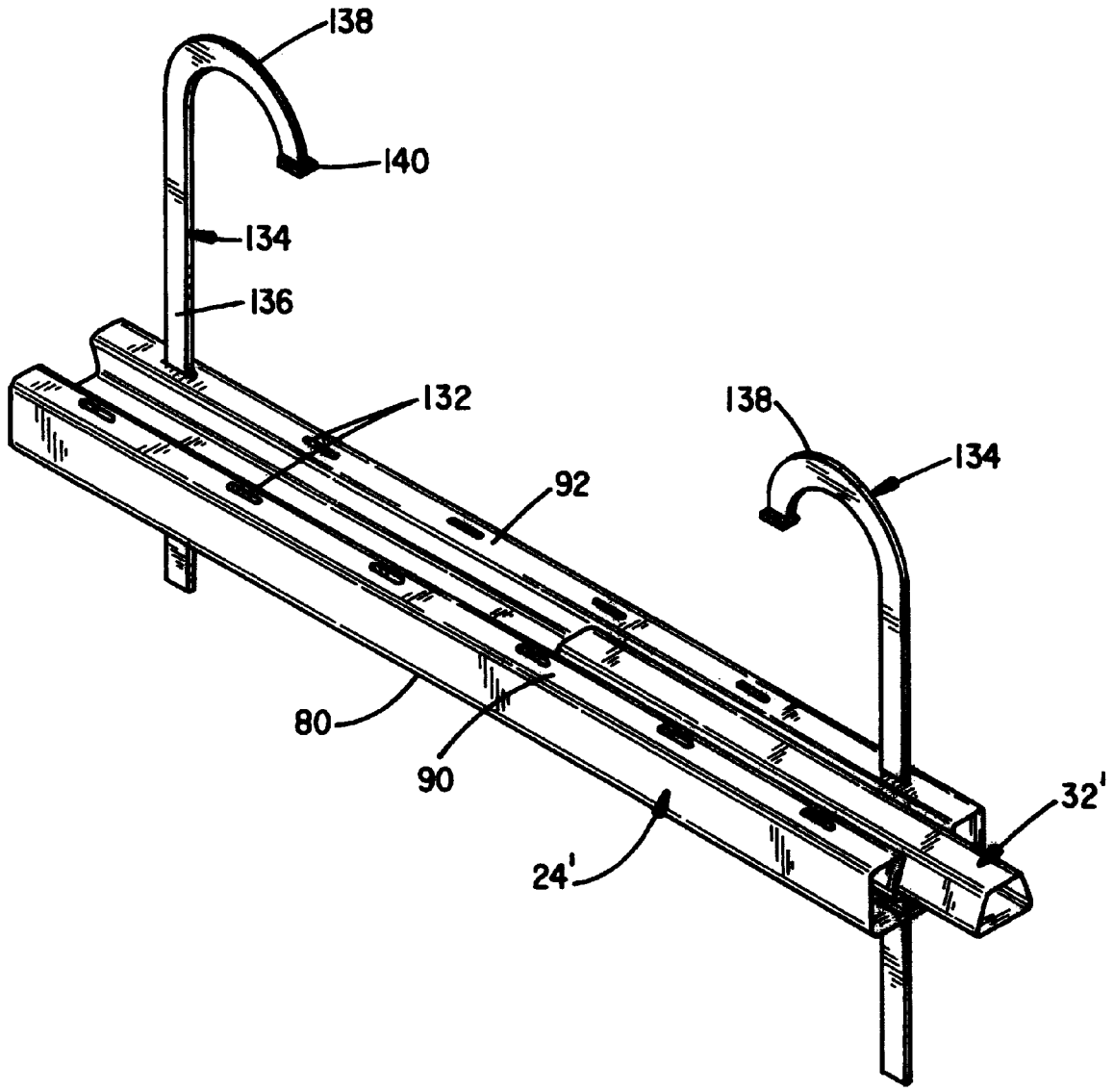
FIG. 7 is a perspective view of the sawhorse extender where the base portion thereof has been modified to accommodate workpiece clamps.
Figure 8:
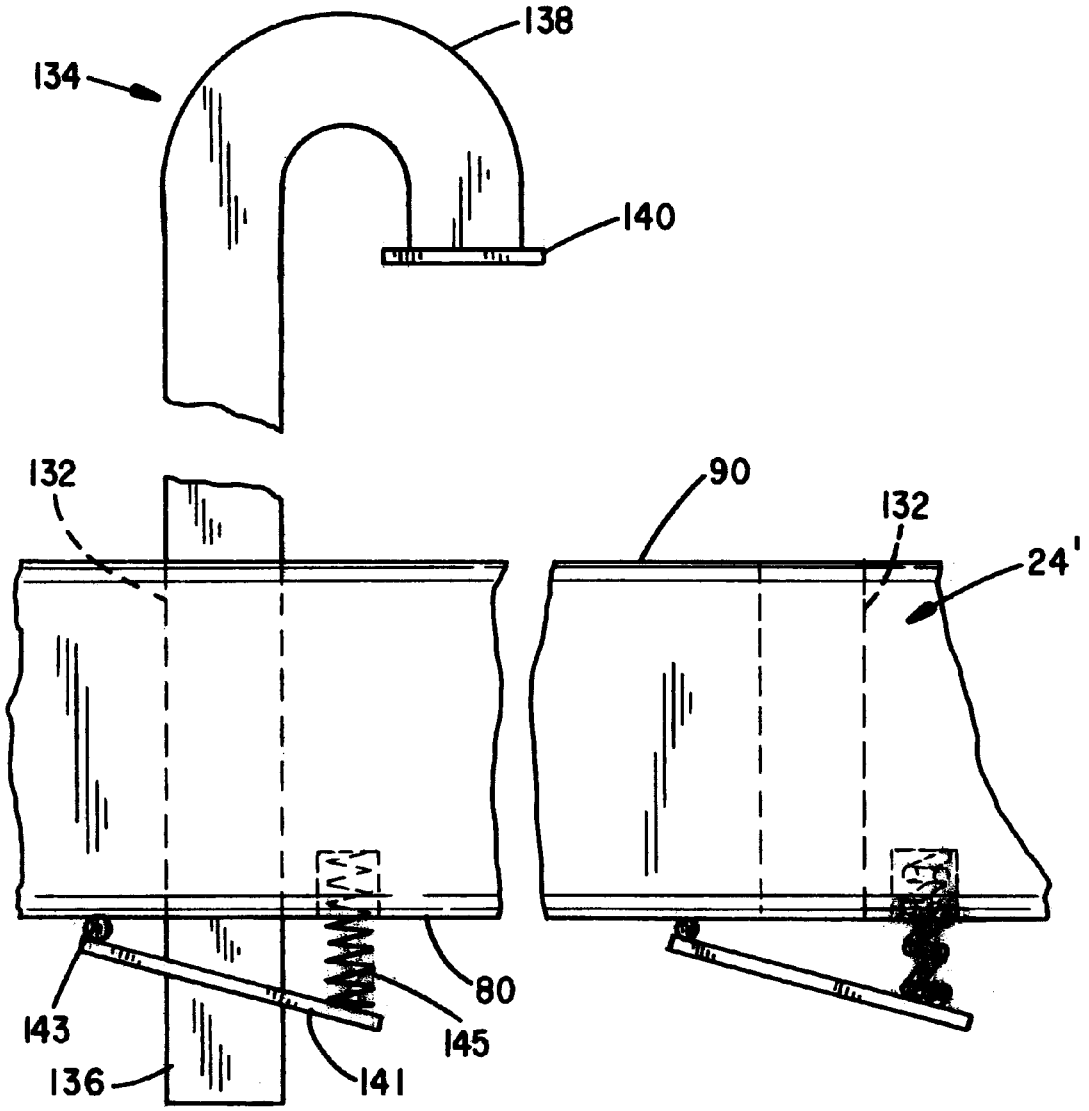
FIG. 8 is a partial side view of the device of FIG. 7 showing the clamp release mechanism.

Referring next to FIG. 7, there is shown an alternative embodiment in which the base member 24' includes a plurality of vertically aligned slots 132 formed in the top surfaces 90 and 92 and in the bottom surface 80 for receiving workpiece clamps 134 therethrough. The clamp members 134 are seen to comprise a straight shank portion 136 of a predetermined length. It may be of a rectangular cross-section, as shown, or, alternatively, may be circular in cross-section if the apertures 132 are correspondingly shaped. The shank is bent to form an arcuate portion 138, the free end of which may carry a pad member 140 for engaging a workpiece.

Affixed to the undersurface of the base member 24' is a clamp release mechanism of the type used on conventional pipe clamps or carpentry clamps. It comprises a flat lever plate 141 having a rectangular slot formed therethrough where the dimensions of the slot are only slightly larger than the corresponding dimensions of the shank portion 136 of the clamp member 134 passing through it. The lever plate 141 is connected by a hinge or pivot 143 to the undersurface 80 of the base member 24' and a compression spring 145 normally urges the lever plate 141 to be at a slight angle with respect to the undersurface 80 of the base member. The lever plate 141 permits a downward force applied to the curved head of the clamp member 134 to cause the pad 140 to be brought against a workpiece resting on the sawhorse extender, but the lever inhibits reverse movement of the clamping member until such time as the lever plate 141 is squeezed against the force of the spring 145 to bring the plate 141 in a perpendicular relationship to the shank 136 of the clamping member, thereby releasing the clamp.

Figure 9:
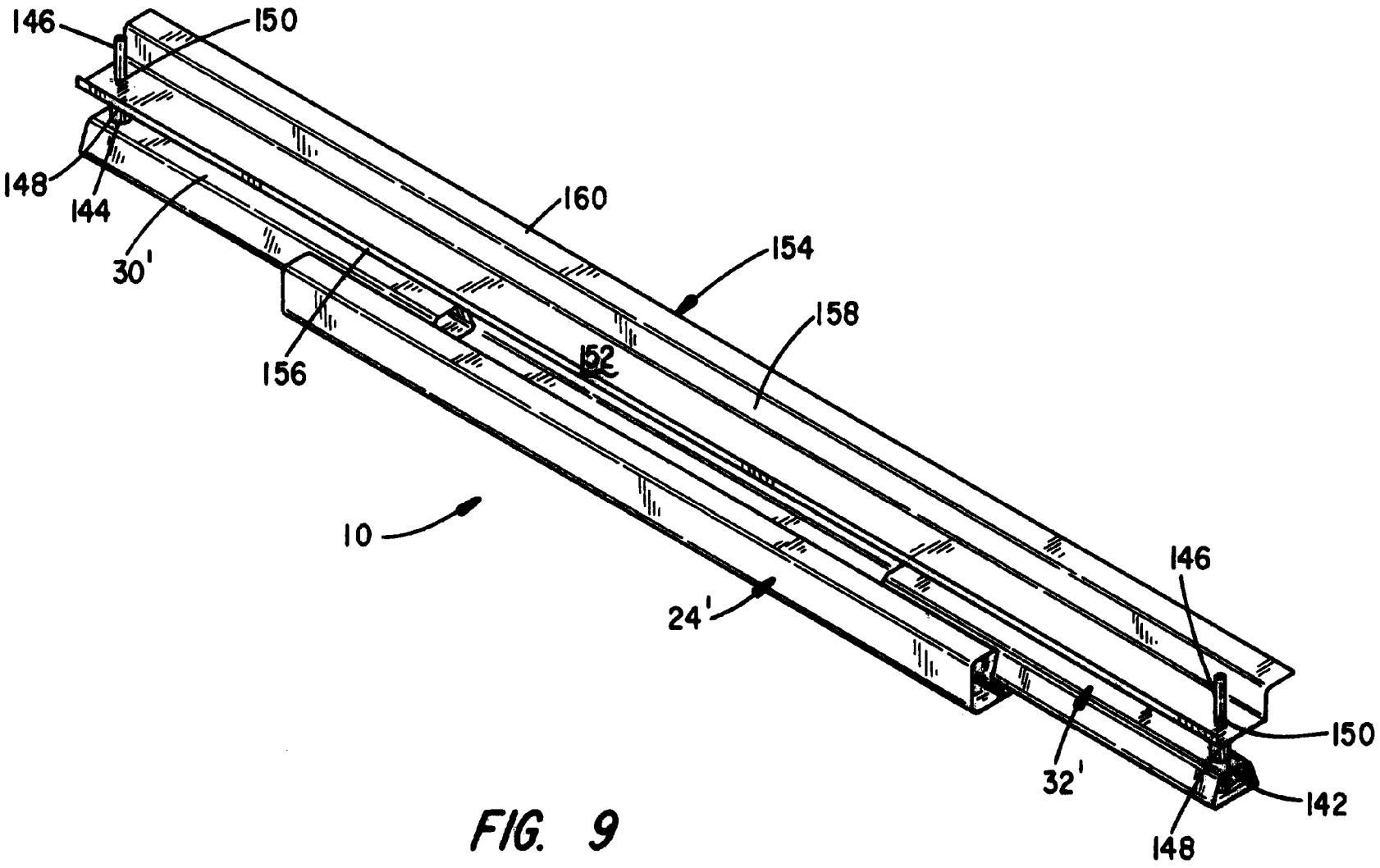
FIG. 9 is a perspective view of the alternative embodiment of the sawhorse extender and including a saw guide attachment therewith.

An additional feature of the present invention is illustrated in FIG. 9. Here, the sawhorse extender assembly 10, with its base 24' and its extender members 30' and 32' shown projecting laterally outward from the base includes bores 142 and 144 formed through the top surfaces of the extender members proximate their outer ends. Fitted into the bores 142 and 144 are saw guide alignment pins 146. The alignment pins pass through one or more annular spacers 148 and through apertures 150 formed in the base 152 of a saw guide 154. By selecting an appropriate number of spacers 148, the gap between the base 152 of the saw guide and the top surface of the sawhorse extender assembly 10 can be set to permit a workpiece, such as a sheet of plywood, to fit between the saw guide 154 and the top surfaces of the sawhorse extender 10.

The saw guide 154 comprises a bent sheet metal strip or an extrusion having an upturned edge 156 extending the length of the base member 152 and an integrally formed vertical wall 158 extending from the opposite edge of the base member 152 and ending in a horizontally extending flange 160. A workman, using a conventional radial saw will abut the shoe of the radial saw on the surface 152 with the edge of the saw's shoe abutting the vertical wall 158. The saw may then be made to traverse the workpiece with the saw guide 154 insuring a straight line cut.

The present invention has been found to greatly facilitate working on items whose width dimension exceeds the width of a conventional sawhorse in that it becomes positively supported over its full width dimension and precluded from lateral movement by appropriate placement of the work piece dowels 70 following the setting and locking of the degree of extension of the extension members beyond the ends of the base member.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A sawhorse extender comprising, in combination:

(a) a base member of a predetermined length, width and depth dimension and adapted for attachment to a cross member of a sawhorse, said base member being an extrusion having a planar bottom surface defining said width dimension, first and second opposed side surfaces defining said height dimension and a planar top surface comprising first and second segments each of a predetermined width dimension less than one-half of the width defined by the planar bottom surface, the first and second segments being coplanar and extending inward from said opposed side surface leaving a gap of a predetermined width dimension therebetween, an intermediate surface supported above and parallel to said planar bottom surface, and having a width dimension greater than the predetermined width dimension of the gap, and interior walls joining facing edges of said first and second segments to said intermediate surface, said intermediate surface and said interior walls defining a containment channel;

(b) at least one extender member of a predetermined length and shaped to fit endwise into said containment channel and to be slidable therein, and (c) at least one stop member mounted in the at least one extender member, the stop member including a pivotal stop plate movable from a position coplanar with the top surface of the base member to a position perpendicular to the top surface.

2. The sawhorse extender of claim 1 and further including at least one electrical outlet mounted in one of the side surfaces of the base member.

3. The sawhorse extender of claim 1 and further including a spirit level mounted in one of the first and second segments of the top surface.

4. The sawhorse extender of claim 1 wherein scale markings are provided along the length of the first and second segments.

5. The sawhorse extender of claim 1 and further including:

(a) a plurality of apertures at spaced intervals along a length dimension of the first and second segments of the top surface, each of the plurality of apertures being aligned with a corresponding one of a plurality of apertures formed in the planar bottom surface of the base member;

(b) a clamp member having a shank portion insertable through selected one of the aligned apertures; and (c) a manually operated clamp release lever affixed to the base member and cooperating with the shank portion of the clamp member.

6. The sawhorse extender of claim 1 and further including a further extender member slidingly received in the containment channel.

7. The sawhorse extender of claim 6 wherein the at least one extender member and the further extender member each include a vertically extending bore formed proximate one end thereof; first and second alignment pins fitted into said vertically extending bores; and an elongated rectilinear saw guide member having a flat, horizontal base of a predetermined length and width dimension, with an integral vertical wall extending upward from a longitudinal edge of said base; said base having apertures proximate opposed ends thereof for receiving the alignment pins therethrough, said vertical wall adapted to cooperate with a shoe plate of a radial saw as a guide.

8. A sawhorse extender attachment comprising, in combination with an existing sawhorse:

(a) a base member of a predetermined length, width and depth dimension and releasably attached to a cross member of the existing sawhorse, said base member comprising a hollow, generally tubular extrusion with a planar bottom surface, said bottom surface defining said width dimension, first and second opposed side surfaces defining said height dimension and a planar top surface comprising first and second longitudinally extending segments, each of a predetermined width dimension less than one-half of the width defined by the planar bottom surface, the planar top surface of the first and second segments being coplanar and extending inward from said opposed side surfaces, leaving a gap of a predetermined width dimension therebetween, an intermediate surface supported above and parallel to said planar bottom surface, and having a width dimension greater than the predetermined width dimension of the gap, and interior walls joining facing edges of said first and second segments to said intermediate surface, said intermediate surface and said interior walls defining a containment channel; and (b) at least one elongated, extruded, tubular extender member of a predetermined length and a cross-sectional shape corresponding to that of the containment channel and capable of fitting end wise into said containment channel and to be slidable therein.

9. The sawhorse extender of claim 8 and further including at least one stop member mounted in the one of the first and second segments, the stop member including a pivotal stop plate movable from a position coplanar with the top surface of the base member to a position perpendicular to the top surface.

10. The sawhorse extender of claim 8 and further including at least one electrical outlet mounted in one of the side surfaces of the base member.

11. The sawhorse extender of claim 8 and further including a spirit level mounted in one of the first and second segment of the top surface.

12. The sawhorse extender of claim 8 wherein scale markings are provided along the length of the first and second segments.

13. The sawhorse extender of claim 8 and further including:

(a) a plurality of apertures at spaced intervals along a length dimension of the first and second segments of the top surface, each of the plurality of apertures being aligned with a corresponding one of a plurality of apertures formed in the planar bottom surface of the base member;

(b) a clamp member having a shank portion insertable through selected one of the aligned apertures; and (c) a manually operated clamp release lever affixed to the base member and cooperating with the shank portion of the clamp member.

14. The sawhorse extender of claim 8 and further including a further extender member slidingly received in the containment channel.

15. The sawhorse extender of claim 14 wherein the at least one extender member and the further extender member each include a vertically extending bore formed proximate one end thereof; first and second alignment pins fitted into said vertically extending bores; and an elongated rectilinear saw guide member having a flat, horizontal base of a predetermined length and width dimension, with an integral vertical wall extending upward from a longitudinal edge of said base; said base having apertures proximate opposed ends thereof for receiving the alignment pins therethrough, said vertical wall adapted to cooperate with a shoe plate of a radial saw as a guide.

* * * * *

UNITED STATES PATENT AND TRADEMARK OFFICE

CERTIFICATE OF CORRECTION

PATENT NO. : 6,123,173
DATED : September 26, 2000
INVENTOR(S) : George Patros et al.

It is certified that error appears in the above-identified patent and that said Letters Patent is hereby corrected as shown below:

Title page,
Item [76], Inventor , after "George Patros, 645 NE Fairmont St., Fridley, Minn. 55432" add
-- ; and Dennis Mills, 2265 Daniels St., Long Lake, Minn. 55356 --

Signed and Sealed this

Eighteenth Day of December, 2001

*Attest:*

*Attesting Officer*

JAMES E. ROGAN
*Director of the United States Patent and Trademark Office*